US008567519B2

(12) United States Patent
Poeckl

(10) Patent No.: US 8,567,519 B2
(45) Date of Patent: Oct. 29, 2013

(54) GROUND WORKING DEVICE

(75) Inventor: Rudolf Poeckl, Schrobenhausen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 350 days.

(21) Appl. No.: 13/072,272

(22) Filed: Mar. 25, 2011

(65) Prior Publication Data

US 2011/0253400 A1 Oct. 20, 2011

(30) Foreign Application Priority Data

Apr. 16, 2010 (EP) ..... 10004082

(51) Int. Cl.
*E21B 21/015* (2006.01)
*E02D 5/56* (2006.01)

(52) U.S. Cl.
USPC ..... 173/1; 173/184; 173/28; 173/147; 173/148; 175/57; 175/209; 405/232; 405/241

(58) Field of Classification Search
USPC ..... 173/1, 11, 28, 147, 148, 152, 164, 184, 173/185; 175/57, 209, 211, 323; 405/145, 405/232, 241; 166/77.2, 85.5, 384
See application file for complete search history.

(56) References Cited

U.S. PATENT DOCUMENTS 3,754,604 A * 8/1973 Inaba et al. ..... 173/28
3,994,350 A * 11/1976 Smith et al. ..... 175/85
4,103,745 A * 8/1978 Varich et al. ..... 173/197
4,126,193 A * 11/1978 Brown et al. ..... 175/171
4,296,819 A * 10/1981 Griste ..... 173/147
4,371,041 A * 2/1983 Becker et al. ..... 173/28
4,371,046 A * 2/1983 Read ..... 175/57
4,465,144 A * 8/1984 Gugger et al. ..... 173/28
4,544,040 A * 10/1985 Sweeney ..... 173/91

(Continued)

FOREIGN PATENT DOCUMENTS

EP 0548900 A2 6/1993
EP 1580398 A1 9/2005

(Continued)

OTHER PUBLICATIONS

H.Geiger; European Search Report; EP10004082; Oct. 13, 2010.

*Primary Examiner* — Scott A. Smith
(74) *Attorney, Agent, or Firm* — Studebaker & Brackett PC

(57) ABSTRACT

The invention relates to a ground working device comprising a carrier implement, a mast that forms a mast sequence and has a lower mast part, which is linked to the carrier implement, an upper mast part and at least one mast extension piece, whereby for the purpose of increasing the mast length the mast extension piece is removably inserted into the mast sequence between lower mast part and upper mast part and removed from the mast sequence, and, with the mast extension piece removed, the upper mast part can be fixed directly on the lower mast part, a work sledge which is guided in a displaceable manner along the mast, and at least one feed rope for displacing the work sledge, which runs at least in some areas longitudinally of the mast. The ground working device according to the invention is characterized in that a reel for receiving slack rope is provided that develops on the feed rope when the mast extension piece is removed from the mast sequence and the upper mast part is fixed directly on the lower mast part. The invention also relates to a method for operating a ground working device of such type.

14 Claims, 3 Drawing Sheets

(56) References Cited

U.S. PATENT DOCUMENTS

| | | | | |
|---|---|---|---|---|
| 4,759,414 | A * | 7/1988 | Willis | 175/170 |
| 4,785,892 | A * | 11/1988 | Luen | 173/28 |
| 4,877,091 | A * | 10/1989 | Howell, Jr. | 173/89 |
| 4,899,832 | A * | 2/1990 | Bierscheid, Jr. | 173/187 |
| 5,222,564 | A * | 6/1993 | Bonca | 173/189 |
| 5,746,277 | A * | 5/1998 | Howell, Jr. | 173/184 |
| 6,533,045 | B1 * | 3/2003 | Cooper | 173/28 |
| 6,536,541 | B2 * | 3/2003 | Pedrelli | 175/135 |
| 7,111,689 | B2 * | 9/2006 | Wise et al. | 166/384 |
| 7,575,398 | B2 * | 8/2009 | Lloyd et al. | 405/232 |
| 7,677,839 | B2 * | 3/2010 | Stoetzer | 405/232 |
| 7,775,300 | B2 * | 8/2010 | Krollmann | 175/57 |
| 8,002,048 | B2 * | 8/2011 | Saehn et al. | 173/184 |

FOREIGN PATENT DOCUMENTS

| | | | |
|---|---|---|---|
| EP | 1849919 | A1 | 10/2007 |
| EP | 1884619 | A1 | 2/2008 |
| EP | 1978204 | A1 | 10/2008 |
| WO | 2009/111845 | A1 | 9/2009 |
| WO | 2009/118386 | A1 | 10/2009 |

* cited by examiner

GROUND WORKING DEVICE

BACKGROUND OF THE INVENTION

The invention relates to a ground working device having the features of the preamble of claim 1. A ground working device of such type is designed with a carrier implement, a mast that forms a mast sequence and has a lower mast part, which is linked to the carrier implement, an upper mast part and at least one mast extension piece, whereby for the purpose of increasing the mast length the mast extension piece can be inserted into the mast sequence between lower mast part and upper mast part, and whereby for the purpose of reducing the mast length the mast extension piece can be released from the upper mast part and the lower mast part and removed from the mast sequence, and, with the mast extension piece removed, the upper mast part can be fixed directly on the lower mast part, a work sledge which is guided in a displaceable manner along the mast, and at least one feed rope for displacing the work sledge, which runs at least in some areas longitudinally of the mast.

It is known to provide ground working apparatuses with masts consisting of multiple parts, in which mast extension pieces arranged in the mast sequence are removed for transport and the remaining mast parts are then reassembled. Through removal of the mast extension pieces from the mast sequence the dimensions of the mast can be reduced for transport purposes. By re-inserting the mast extension pieces the original dimensions of the mast can be re-established again for drilling operation.

BRIEF SUMMARY OF THE INVENTION

The object of the invention is to develop further a generic ground working device in such a manner that an especially easy, quick and secure operation accompanied by especially high reliability is rendered possible particularly with regard to the conversion between an operating configuration and a transport configuration of the ground working device.

The object is solved in accordance with the invention by a ground working device having the features of claim 1. Preferred embodiments are stated in the dependent claims.

The ground working device according to the invention is characterized in that a reel for receiving slack rope is provided that develops on the feed rope when the mast extension piece is removed from the mast sequence and the upper mast part is fixed directly on the lower mast part.

The invention is based on the finding that in a generic ground working device slack rope can develop in the feed rope when the mast extension piece is removed from the mast sequence for transport purposes and the lower mast part and the upper mast part are joined directly. In such case the length of the slack rope can correspond to a multiple of the length of the mast extension piece if the feed rope is repeatedly guided to and fro along the mast. Since this slack rope may interfere with or even endanger the transport of the ground working device, in accordance with the prior art it was necessary in some cases to remove the feed rope for transport or to accommodate it completely on the feed rope winch, which involves corresponding time expenditure, namely both during preparation of the transport and during renewed rigging of the mast when the removed feed rope needs to be reeved anew.

This is where the invention comes in by providing a reel that is adapted for temporary reception of the developing slack rope. By way of such a reel slack rope formation can be prevented without the need for the feed rope to be removed from the mast. Consequently, the feed rope can even remain on the mast during transport whereby the amount of work involved during dismantling or renewed rig-up of the ground working device can be reduced considerably.

The ground working device according to the invention can be designed as a drilling apparatus in particular. The carrier implement according to the invention can suitably be a running gear, as for example a crawler-track running gear. Advantageously, the lower mast part and therefore the mast are pivotably linked to the carrier implement about a horizontally running axis, thus making it possible for the lower mast part and therefore the mast to be pivotable between a vertical operating position and a horizontal set-up and transport position. On the work sledge provision can, in particular, be made for a rotary and/or vibration drive and/or a guide for a ground working tool, as for example a drill rod. The feed rope concerned can be an upper rope in particular, which is guided around the upper side of the mast towards a winch. Provision can also be made for further feed ropes, for example a lower rope that is guided around the underside of the mast.

The reel according to the invention is advantageously designed as a rotary reel, i.e. it has a rotatably supported receiving body for the rope. The receiving body can have receiving arms for example that extend radially outwards from the axis of rotation of the reel. The receiving body can also be designed as a coil.

A preferred embodiment of the invention resides in the fact that the reel is fixed in a releasable manner on the mast. This enables the reel to be attached only if slack rope formation is to be reckoned with, i.e. as a rule during transport of the ground working device. During ground working operation, however, the reel can be removed so that the operation cannot be affected by the reel.

The reel can be fixed e.g. in a hydraulically or mechanically releasable manner on the mast.

In particular, provision can be made for the reel to be arranged on the lower mast part. Since this lower mast part usually remains in place during removal of the mast extension piece, i.e. when the slack rope develops, such an arrangement allows for operational reliability to be enhanced further.

Furthermore, it is advantageous for the reel to be arranged on the lower mast part in an end region of the said lower mast part facing away from the carrier implement, in which case provision can, in particular, be made for the reel to project in the longitudinal direction of the mast beyond the lower mast part. As a result, rope guidance is facilitated further. As a rule, the end region of the lower mast part facing away from the carrier implement is the upper end region of the lower mast part in the case of a vertical mast sequence. Due to the fact that according to the invention the reel projects in the longitudinal direction of the mast beyond the lower mast part provision can be made, in particular, for the reel arranged on the lower mast part to be located in the region of the upper mast part, as seen in the longitudinal direction of the mast, when the upper mast part is fixed directly on the lower mast part for transport purposes.

Moreover, it is useful for the reel to be arranged on a mast's rear side facing away from the work sledge. When the mast is in a horizontal position for transport, this rear side of the mast lies above the mast. Therefore, during transport the reel is located in a region that is usually less critical with regard to transport dimensions.

A particularly reliable displacement operation of the work sledge can be ensured in that a rope tensioning cylinder is provided, on which one end of the feed rope is fixed in a releasable manner. This rope tensioning cylinder enables the feed rope to be kept under tension during operation so that an especially precise displacement of the sledge is rendered possible. The rope tensioning cylinder can be designed, in particular, as a hydraulic cylinder. For best suitability, it is connected on the one hand to the feed rope and on the other hand to the mast. More particularly, the rope tensioning cylinder can be provided on the mast extension piece. If the mast extension piece is removed subsequently for transport purposes, the rope tensioning cylinder that is usually not required for transport is also removed so that the transport weight is reduced advantageously. In particular, provision can be made for the end of the feed rope to be fixed with a rope loop on the rope tensioning cylinder, which leads to a further reduction of the work and expenditure required for operation. For instance, provision can be made for the end of the feed rope to be fixed on the piston of the rope tensioning cylinder.

Furthermore, it is useful for the reel to have a fixing means for releasably fixing the feed rope. Accordingly, provision can be made for the reel to be only located in the course of the feed rope if slack rope formation is to be reckoned with. As a result, operational reliability is increased further. In particular, it is preferred that the fixing means is provided for releasably fixing the rope loop of the feed rope. Thus, for transport the rope loop can be removed in an especially easy way from the rope tensioning cylinder and connected to the reel.

In accordance with the invention the mast is pivotably arranged on the carrier implement between a vertical operating position and a horizontal set-up and transport position, whereby transport is facilitated.

Another preferred further development of the invention resides in the fact that a reel drive for actuating the reel is provided, which may permit automatic operation. Basically, the feed rope could also be wound manually onto the reel.

Moreover, it is useful for a reel brake to be provided for securing the reel. In this way, unintentional unwinding of the feed rope from the reel during transport can be prevented.

By preference, the upper mast part has at least one deflection roller for the feed rope, which can facilitate rope guidance. Several deflection rollers for the feed rope can also be provided on the upper mast part.

The invention also relates to a method for operating a ground working device according to the invention, in which the mast with inserted mast extension piece is pivoted from a vertical operating position into a horizontal set-up and transport position, the reel is fixed on the mast, the mast extension piece is released and removed from the lower mast part and the upper mast part and the upper mast part is fixed directly on the lower mast part, and at least a part of the feed rope is wound onto the reel. As a result, the slack rope formed during removal of the mast extension piece can be received and the advantages set out in conjunction with the ground working device according to the invention can be implemented.

It is especially useful for the reel to be fixed on the mast after the mast has been pivoted into the horizontal set-up and transport position. This allows for a particularly easy installation of the reel.

Furthermore, it is of advantage that for winding up the feed rope one end of the feed rope is released from a first fixing point provided on the mast, in particular on a rope tensioning cylinder, and is subsequently fixed on a second fixing point provided on the reel. This can be realized by a corresponding shifting of the rope loop. According to this embodiment the reel is only connected to the feed rope in order to receive the feed rope during transport and is otherwise removed from the course of the rope, whereby operational reliability is increased further.

In addition, it is particularly useful for the rope tensioning cylinder to be relaxed before removal of the mast extension piece. This permits an especially easy dismantling of the mast extension piece.

BRIEF DESCRIPTION OF THE SEVERAL VIEWS OF THE DRAWINGS

In the following the invention is described in greater detail by way of preferred embodiments illustrated schematically in the accompanying Figures, wherein show.

DETAILED DESCRIPTION OF THE INVENTION

Figure 1:
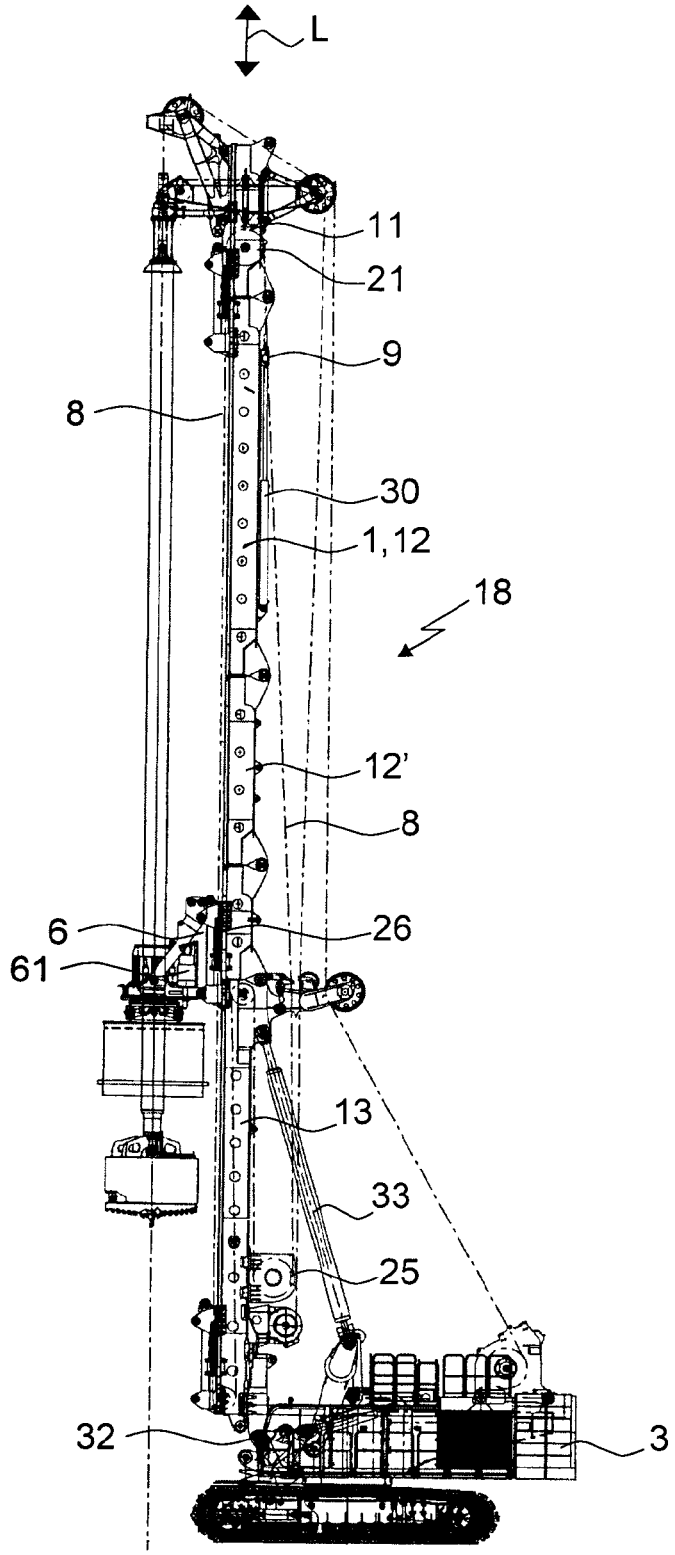
FIG. 1 a side view of a ground working device according to the invention with the mast located in the vertical operating position.
Figure 2:
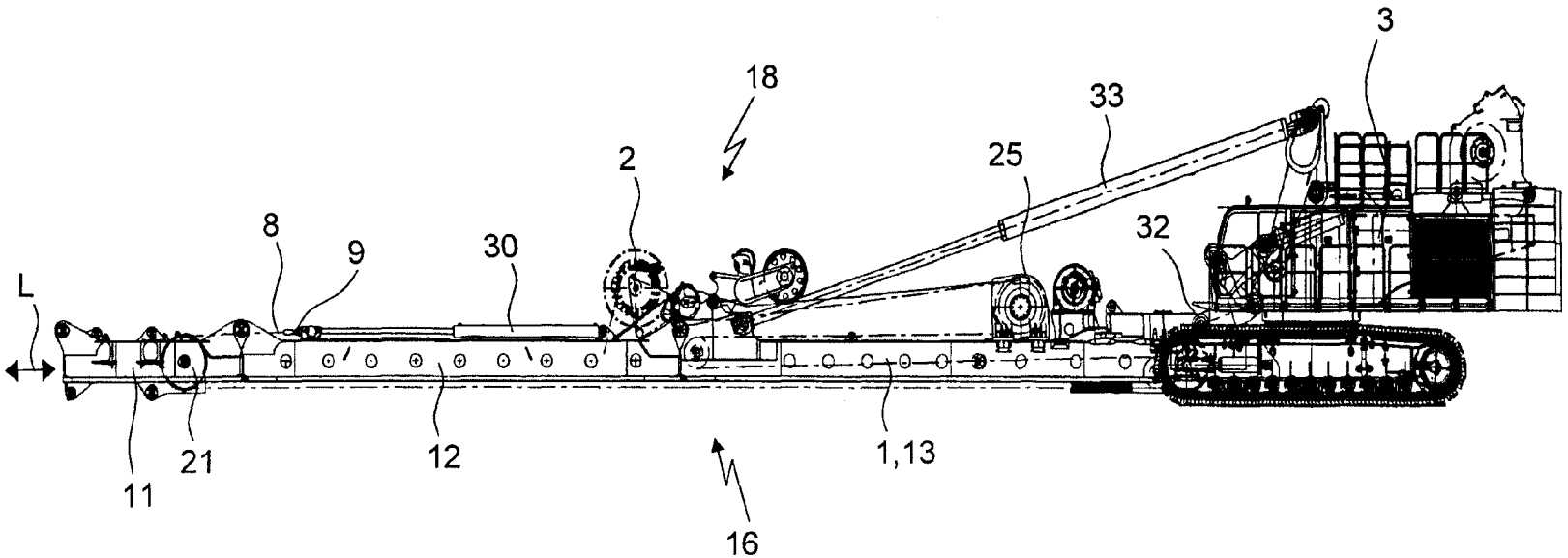
FIG. 2 the ground working device of FIG. 1 with the mast located in the horizontal set-up and transport position in side view.
Figure 3:
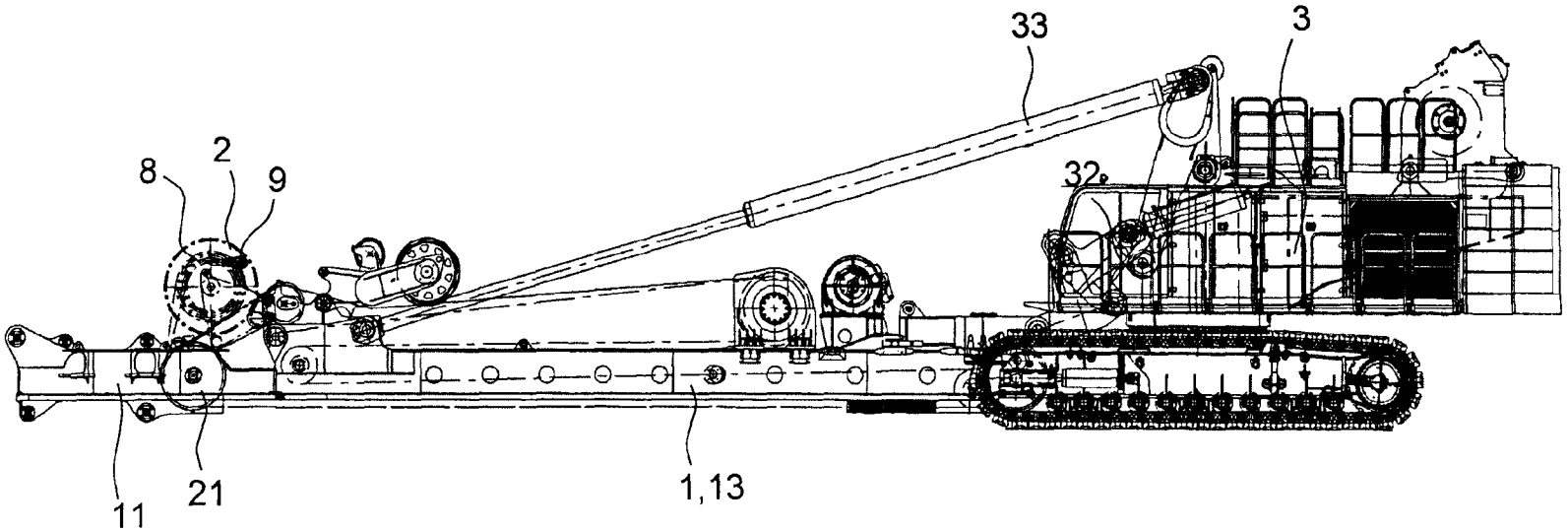
FIG. 3 the ground working device of FIGS. 1 and 2 with the mast located in the horizontal set-up and transport position when the mast extension piece is removed in side view.

An embodiment of a ground working device according to the invention is shown in FIGS. 1 to 3. The ground working device has a carrier implement 3 with an upper carriage that is arranged on a running gear designed as a crawler-track running gear. To this carrier implement 3 a mast 1 is linked via a joint 32 having a horizontally extending joint axis. Through this joint 32 the mast 1 can be pivoted between the operating position depicted in FIG. 1 and the set-up and transport position depicted in FIGS. 2 and 3.

For active pivoting of the mast 1 a neck cylinder 33 is provided, which is linked on the one hand to the mast 1 and on the other hand to the carrier implement 3.

On the mast 1 a work sledge 6 is provided, which is arranged on the mast 1 by being displaceable in the longitudinal direction L of the mast 1. On this work sledge 6 a rotary drill drive 61 for a drill rod can be provided for example.

For displacement of the work sledge 6 provision is made, among other things, for a feed rope 8 designed as an upper rope that can be actuated by a rope winch 25. For tensioning of the feed rope 8 a rope tensioning cylinder 30 is arranged on the mast's rear side 18 of the mast 1, i.e. on the mast side facing away from the work sledge 6. The hydraulic rope tensioning cylinder 30 is connected on the one hand, in particular on its cylinder housing, to the mast 1 and on the other hand, in particular on its piston rod, to the feed rope 8. At its end the feed rope 8 has a rope loop 9 through which the connection with the rope tensioning cylinder 30 is realized. In the operating position shown in FIG. 1 the rope tensioning cylinder 30 serves to keep the feed rope 8 tensioned. From the rope tensioning cylinder 30 the feed rope 8 runs over a deflection roller 21 mounted in an upper region of the mast 1 towards the work sledge 6, on which at least one further deflection roller 26 is provided. Over this deflection roller 26 of the work sledge 6 the feed rope 8 runs back towards the upper end region of the mast 1 and from there over a second deflection roller, not shown here, in the downward direction towards the rope winch 25 which is connected to the mast 1 and on which the second end of the feed rope 8 can be fixed.

As shown in FIG. 2, in particular, the mast 1 is designed of three parts having a lower mast part 13, on which the mast 1 is connected to the carrier implement 3 via joint 32, a mast extension piece 12, which follows on from the lower mast part 13 where required, and finally an upper mast part 11, on which the deflection roller 21 is arranged. In FIG. 1 a further mast extension piece 12' is shown by way of example between upper mast part 11 and lower mast part 13.

As shown in FIGS. 2 and 3, on the mast 1 a reel 2 can be provided when necessary, which serves to receive slack rope occurring on the feed rope 8 during conversion of the mast 1. In particular, the reel 2 can be arranged on the mast's rear side 18 on the lower mast part 13, namely in an end region 16 of the lower mast part 13 facing away from the carrier implement 3. In the illustrated embodiment the reel 2 is arranged such that it projects beyond the lower mast part 13 and is thereby arranged in the region of the adjoining mast extension piece 12 or upper mast part 11 respectively.

FIGS. 1 to 3 illustrate different method steps during conversion of the ground working device from an operating position into a transport position in a method according to the invention. Initially, the mast 1 which is shown in its vertical operating position in FIG. 1 is folded over e.g. through extension of the neck cylinder 33 into its set-up and transport position shown in FIG. 2. Then the reel 2 is fitted e.g. mechanically and/or hydraulically on the lower mast part 13. The rope tensioning cylinder 30 is relaxed and the mast extension piece 12 is released from the upper mast part 11 and the lower mast part 13 and removed together with the rope tensioning cylinder 30. Subsequently, the upper mast part 11 is fixed directly on the lower mast part 13. This state in which the mast 1 is shortened by the length of the mast extension piece 12 is shown in FIG. 3.

On removal of the mast extension piece 12 and the direct joining of upper mast part 11 and lower mast part 13 a length of rope is set free in the feed rope 8 that corresponds to a multiple of the length of the mast extension piece 12. In order to prevent slack rope formation in this connection the feed rope 8 can be wound up by means of the reel 2. To this end the feed rope 8 is fixed via the rope loop 9 on the reel 2 and the said reel is actuated.

The invention claimed is:

1. Ground working device comprising a carrier implement, a mast that forms a mast sequence and has a lower mast part, which is linked to the carrier implement, an upper mast part and at least one mast extension piece, whereby for the purpose of increasing the mast length the mast extension piece can be inserted into the mast sequence between lower mast part and upper mast part, and whereby for the purpose of reducing the mast length the mast extension piece can be released from the upper mast part and the lower mast part and removed from the mast sequence, and, with the mast extension piece removed, the upper mast part can be fixed directly on the lower mast part, a work sledge which is guided in a displaceable manner along the mast, and at least one feed rope for displacing the work sledge, which runs at least in some areas longitudinally of the mast, wherein a reel for receiving slack rope is provided that develops on the feed rope when the mast extension piece is removed from the mast sequence and the upper mast part is fixed directly on the lower mast part.

2. Ground working device according to claim 1, wherein the reel is fixed in a releasable manner on the mast.

3. Ground working device according to claim 1, wherein the reel is arranged on the lower mast part.

4. Ground working device according to claim 3, wherein the reel is arranged on the lower mast part in an end region of the said lower mast part facing away from the carrier implement and in that the reel projects in the longitudinal direction (L) of the mast beyond the lower mast part.

5. Ground working device according to claim 1, wherein the reel is arranged on a mast's rear side facing away from the work sledge.

6. Ground working device according to claim 1, wherein in particular on the mast extension piece a rope tensioning cylinder is provided, on which one end of the feed rope is fixed in a releasable manner with a rope loop.

7. Ground working device according to claim 6, wherein the reel has a fixing means for releasably fixing the feed rope, in particular the rope loop of the feed rope.

8. Ground working device according to claim 1, wherein the mast is pivotably arranged on the carrier implement between a vertical operating position and a horizontal set-up and transport position.

9. Ground working device according to claim 1, wherein a reel drive for actuating the reel and/or a reel brake for securing the reel is provided.

10. Ground working device according to claim 1, wherein the upper mast part has at least one deflection roller for the feed rope.

11. Method for operating a ground working device, said ground working device including:

a carrier implement, a mast that forms a mast sequence and has a lower mast part, which is linked to the carrier implement, an upper mast part and at least one mast extension piece, whereby for the purpose of increasing the mast length the mast extension piece can be inserted into the mast sequence between lower mast part and upper mast part, and for the purpose of reducing the mast length the mast extension piece can be released from the upper mast part and the lower mast part and removed from the mast sequence, and, with the mast extension piece removed, the upper mast part can be fixed directly on the lower mast part, a work sledge which is guided in a displaceable manner along the mast, and at least one feed rope for displacing the work sledge, which runs at least in some areas longitudinally of the mast, wherein a reel for receiving slack rope is provided that develops on the feed rope when the mast extension piece is removed from the mast sequence and the upper mast part is fixed directly on the lower mast part;

in which the mast with inserted mast extension piece is pivoted from a vertical operating position into a horizontal set-up and transport position, the reel is fixed on the mast, the mast extension piece is released and removed from the lower mast part and the upper mast part and the upper mast part is fixed directly on the lower mast part, and at least a part of the feed rope is wound onto the reel.

12. Method according to claim 11, wherein the reel is fixed on the mast after the mast has been pivoted into the horizontal set-up and transport position.

13. Method according to claim 11,
wherein
for winding up the feed rope one end of the feed rope is released from a first fixing point provided on the mast, in particular on a rope tensioning cylinder, and is subsequently fixed on a second fixing point provided on the reel.

14. Method according to claim 13,
wherein
the rope tensioning cylinder is relaxed before removal of the mast extension piece.

* * * * *